US005973591A

United States Patent [19]

Schwartz et al.

[11] Patent Number: 5,973,591

[45] Date of Patent: Oct. 26, 1999

[54] ELECTRONIC SIGNALING SYSTEM

[76] Inventors: David Schwartz, 808 Zinfandel La., St. Helena, Calif. 94574; Richard S. Davis, 935 Hamilton Ave., Menlo Park, Calif. 94025

[21] Appl. No.: 08/974,528

[22] Filed: Nov. 19, 1997

[51] Int. Cl.[6] ..... G08B 3/10

[52] U.S. Cl. ..... 340/384.7; 340/384.1; 446/404

[58] Field of Search ..... 340/384.7, 384.1, 340/384.4; 446/302, 404, 484; 379/67.1, 88.27, 88.28

[56] References Cited

U.S. PATENT DOCUMENTS

| | | | |
|---|---|---|---|
| 4,715,060 | 12/1987 | Lipscher et al. | 379/70 |
| 5,210,520 | 5/1993 | Housley | 340/326 |
| 5,220,594 | 6/1993 | Ohnishi et al. | 379/61 |
| 5,365,214 | 11/1994 | Angott et al. | 340/328 |
| 5,568,538 | 10/1996 | Tamir et al. | 379/58 |
| 5,570,083 | 10/1996 | Johnson | 340/692 |
| 5,648,753 | 7/1997 | Martin | 340/384.7 |

OTHER PUBLICATIONS

Crutchfield, Winter/Spring 1997 Catalog, p. 26, 1997.

*Primary Examiner*—Daniel J. Wu
*Assistant Examiner*—Ashok Mannava
*Attorney, Agent, or Firm*—Russ, August & Kabat

[57] ABSTRACT

The electronic signaling system comprises a base unit including an audio media player for reproducing a recorded audio signal from an inserted recorded medium, and an audio output stage for producing an audio output responsive to the occurrence of a trigger signal. A remote triggering device, such as a doorbell, includes a signal generator for communicating energy from the triggering device to the base unit. A receiving device in the base unit is provided for intercepting the energy communicated from the triggering device for reproducing the recorded audio signal. The medium may be a replaceable medium, permitting the user to select, from a variety of sound recordings, which recording is to be played back when a visitor or a guest pushes the doorbell. The replaceable medium may be recordable by a user. The audio player is preferably a player capable of reproducing sound patterns from integrated circuits containing encoded or non-encoded sound program information. A simplified electronic signaling system may be placed in a child's room. When a pushbutton outside the child's room is pressed, a preselected sound/audio/song/message/program is played by the base unit in the child's room. The base unit may have a slot for receiving thematic cards having artwork thereon and carrying an IC containing sounds or sound patterns consistent with the theme depicted on the thematic card.

3 Claims, 8 Drawing Sheets

ELECTRONIC SIGNALING SYSTEM

BACKGROUND OF THE INVENTION

1. Field of the Invention

This invention relates to the field of signaling systems, and in particular to a system which provides an audible response to a triggering event, a doorbell system being a nonlimiting example.

2. Brief Description of the Prior Art

Prior art doorbell systems are available in a variety of formats. A pushbutton on the outside of an entrance door wired to a mechanical or an electrical tone generator mounted somewhat centrally of a dwelling or a building remains the most popular format. Although both the electrical and mechanical versions may be provided to emit a single tone or multiple tones played in sequence, such devices are quite limited in their functionality.

For example, U.S. Pat. No. 4,326,276 to Scott, Jr. proposes an electronic tone generator which plays one of a repertoire of musical tunes when a door pushbutton is pressed. Different musical tunes may be selected by the occupant by means of a keyboard connected to a microprocessor. In addition to the playing of a tune when the door pushbutton is pressed, a built-in clock system displays the time of day and enunciates each quarter hour by means of musical notes.

U.S. Pat. Nos. 4,868,540 and 5,210,520 to Housley disclose a programmable doorbell system which displays messages and/or sounds a tone for the visitor pushing the doorbell pushbutton. A digital record/playback circuit may be provided to record an audible announcement by the occupant and stored as a digital signal. The audible announcement is generated from the stored digital signal when the doorbell pushbutton is pressed by a visitor. It is to be noted that these two patents to Housley relate to a programmable doorbell system for communicating visually or audibly to the visitor, and is not concerned with programming or playing recorded signals to the occupant upon the pushing of a doorbell pushbutton by a visitor.

U.S. Pat. No. 5,570,083 to Johnson discloses a doorbell answering system functionally similar to the Housley devices in which the occupant may select whether the system will energize the doorbell announcing the visitor or provide a prerecorded message for playback to the visitor. The doorbell and/or record modes are selected by the user by a switch located within an interior housing mounted adjacent a building entrance. Like the Housley devices, the Johnson system is not concerned with playing different audible messages to the occupant upon pushing of the doorbell pushbutton by a visitor.

U.S. Pat. No. 5,475,369 to Baker proposes a pet sounding device in which, upon physical contact of a wireless transmitter by the pet, sounds, chimes, or voice messages are emitted to alert the occupant that the pet wishes to either enter or exit the house or building. Sound variations are proposed for indicating the location of the actuated pet sensor.

U.S. Pat. No. 5,583,477 to Yen proposes a wireless AC/DC bell system in which an RF transmitter sends a triggering signal to a receiver for driving a speaker with an oscillating tone.

U.S. Pat. No. 5,564,294 to Chen discloses a musical door lock. When a pushbutton on the outer periphery of the door is pressed, a musical melody, or the sound of bird chirps will be emitted from the door lock housing. Chen also proposes a wireless coupling between the door lock arrangement and a movable wireless doorbell. The musical door lock is also proposed to be combined with an antiburglar device.

U.S. Pat. No. 5,365,214 to Angott et al. discloses a musical wireless alerting system in which the occupant is presented with a selection of a song or a melody dependent upon an audio code transmitted by a triggering device. A plurality of stored songs or tones within memory are selectable for transmission to a speaker which plays the tone or song upon initiation of the triggering device. The trigger device is proposed to be, for example, the pushing of a doorbell pushbutton or the opening of the door. Additionally, audible selection means are provided for manually selecting one of the plurality of audio codes representative of different audible indications produced by the audio means. That is, selection of the song or melody is made at the triggering device, and the receiver simply responds to the transmitted audio code from each triggering device to play the selection which the code represents.

SUMMARY OF THE INVENTION

The present invention provides improvements over apparatuses of the prior art, taking a doorbell-type system, a boring yet necessary product found in virtually every residence, to its ultimate level of style, functionality, and fun. The invention allows users to add a personal touch to their door greeting with an excerpt of their favorite song, sound effect, or voice message, delivered in high fidelity. Stylistically, the invention turns an announcement tool into an exciting personal statement, and functionally, the invention gives the user security and flexibility at a very affordable price.

In accordance with the invention, there is provided an electronic signaling system comprising a base unit including an audio media player for reproducing a recorded audio signal from an inserted recorded medium, and an audio output stage for producing an audio output responsive to the occurrence of a trigger signal. A remote triggering device includes a signal generator for communicating energy from the triggering device to the base unit. A receiving device in the base unit is provided for intercepting the energy communicated from the triggering device and generating the trigger signal to reproduce the recorded audio signal and produce the audio output.

In a preferred embodiment of the invention, the inserted recorded medium is a replaceable recorded medium, permitting the user to select from a variety of sound recordings which recording is to be played back when a visitor or a guest pushes the doorbell.

In yet another aspect of the invention, the replaceable recorded medium is recordable, and the audio signal recorded on it is erasable. Additional recorded audio signals may be added to the medium or replace already recorded audio signals.

The audio player is preferably integrated circuitry containing digitally encoded sound program information, analog sound program information, or compressed analog sound program information, and may be factory installed or locally (or remotely) recorded and stored by a user. One embodiment of the invention includes a sound recorder which may be fixed within a main base unit and/or may be removable from the main base unit to permit the recording of sounds not capturable in the vicinity of the main base unit. In such a case, the removable sound/audio recorder is self-powered and may include a built-in microphone and may optionally be provided with a direct line level input.

In yet another aspect of the invention, a simplified electronic signaling system for placement in a child's room is proposed. When a pushbutton outside the child's room is pressed, a preselected sound/song/message/program is played by the base unit in the child's room. The base unit may have a slot for receiving thematic cards having artwork thereon and carrying integrated circuitry containing sounds or sound patterns consistent with the theme depicted on the thematic card. Additionally, when the theme card is inserted into the slot of the base unit, the artwork is viewable through a view window typically made in the side of the base unit. In this manner, the child may enjoy listening to one of his or her favorite sounds, songs, tunes, noises, voices, etc. while viewing, through the base unit window, a picture having the same theme as the sound recording.

BRIEF DESCRIPTION OF THE DRAWING

These and other aspects of the invention will be better understood, and additional features of the invention will be described hereinafter having reference to the accompanying drawings in which.

DETAILED DESCRIPTION OF THE PREFERRED EMBODIMENTS

Definition of Terms

Figure 1:
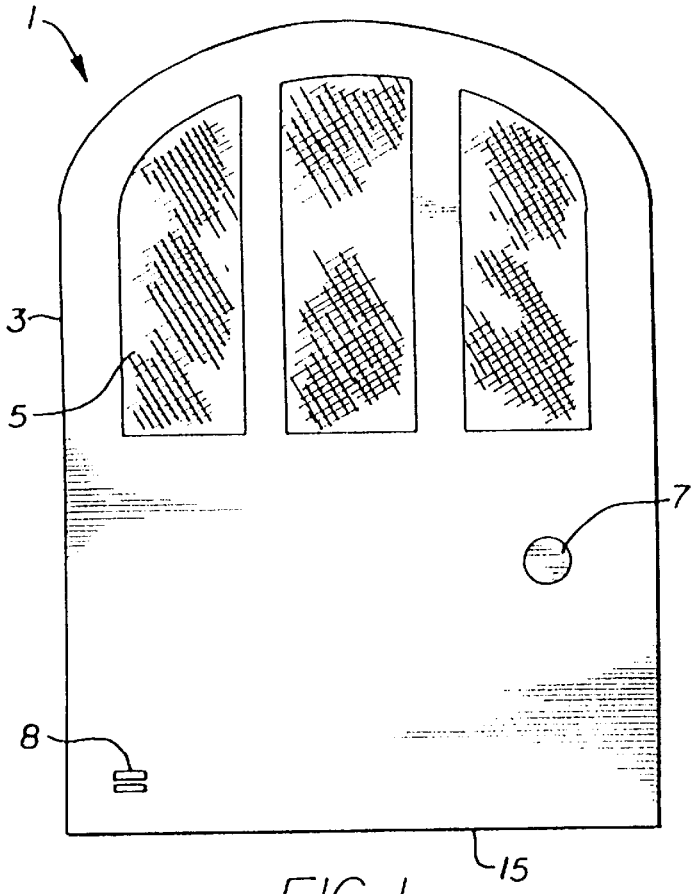
FIG. 1 is a front elevational view of a main base unit having an audio playback function.

As used in this description, the following terms are defined.

A "main base unit", or simply "base unit" contains means to receive a triggering signal and to operate electronic circuits within to produce various sounds, i.e. to produce audible recorded sound patterns, upon receiving the triggering signal. The base unit has a port, or receptacle, to receive a plug-in module in which the sound patterns are stored. The plug-in module may include a recording facility. In one embodiment, the entire system is portable, may be plugged directly into an AC line voltage receptacle, and is self-contained so as to easily facilitate locating the base unit near a sound source, thereby maximizing its ability to record desirable sound records at any location via a microphone.

A "remote triggering device" is defined as any device which generates a signal for communicating energy to the base unit. The remote triggering device may be a doorbell pushbutton, a voice-actuated sensor, or a device responsive to the breaking of an energy beam by an object (e.g. a light beam source and sensor), all including magnetic, electrostatic, and/or electromagnetic energy transmitters.

A "media player" is any device which reads information from a medium upon which information is stored and converts it to an audio signal which can be used to drive an audio reproducer, including an audio amplifying and speaker combination.

An "audio media recorder" is any device which can record or store information representing an audio/sound signal onto a medium for later reproduction.

A "recorded medium" is defined as an integrated circuit (hereinafter IC), a magnetic storage device, an optical storage device, or any other storage device in which information representing audio/sound may be recorded or stored for later reproduction. A "recorded media" may be a read-only medium, or it may be a recordable medium in which information representing audio/sound may be added to existing recorded information on the medium or may replace information previously recorded on the medium.

A "clip chip" is an IC in which, typically, short duration audio/sound information has been recorded, or in which audio/sound information may be recorded by the user. The short duration audio/sound information may be referred to herein as a "sound clip".

A "clip chip module" is a plug-in module carrying a clip chip.

A "play only clip chip module" comprises a read-only clip chip and electrical connections for outputting the stored audio information. A typical "play only clip chip module" stores audio data on an IC in digital form. A "record/play clip chip module", which may also be referred to herein as a ChipCorder® (registered trademark of Information Storage Devices of San Jose Calif., comprises a clip chip and elements necessary to record and playback sound clips. The peripheral elements may include a microphone, line input, record switch, and internal power source.

A "theme card" or "thematic card" is a convenient carrier in which, or on which, the IC die of a clip chip module is disposed. The IC die may be embedded in the card which has electrical interconnects to supply power and control and to pass stored audio to the base unit on demand. The theme or thematic card may have artwork on at least one of its surfaces, the artwork having some correspondence with the audio/sound information recorded on the IC chip die carried by the card.

Turning now to FIG. 1, there is shown a base unit 1 having a housing 3 which contains the electronics for the base unit, to be described later. Among the internal electronics within housing 3 is a high fidelity loudspeaker (not visible in FIG. 1) disposed behind grill cloth 5. Since sound recordings will be played by the base unit 1, a volume control 7 is provided for the user's convenience on the front of the housing 3.

Figure 2:
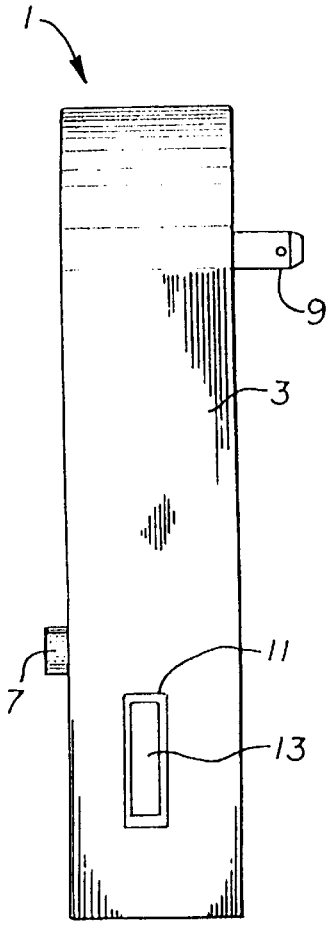
FIG. 2 is a right side elevational view of the basic unit shown in FIG. 1.

FIG. 2 is a right side view of the base unit shown in FIG. 1. FIG. 2 shows the location of the AC plug prongs 9 for insertion into a common household wall receptacle (not shown) for powering the base unit 1. In the side of housing 3, a slot 11 is provided for receiving a removable sound storage device 13 which may take on a variety of forms and function, as will be described in this specification. Also known as, and referred to herein as, a clip chip module, sound storage device 13 contains recorded audio sound patterns (songs, talking, sound effects, etc.). The size, shape, and placement of slot 11 is a matter of design choice and is shown in FIG. 2 to be on the side of the housing 3 for convenience of description in this specification. The sound storage device 13 may comprise a read-only memory for playback of the stored audio sound patterns, and the circuitry may be supplied on a convenient carrier (yet to be described) rather than being contained in a module form.

Alternatively, the sound storage device 13 may comprise a recordable memory device with or without prerecorded audio sound patterns and with or without apparatus for recording information in the memory device. For these reasons, the sound storage device 13 will be described herein using different reference numerals, as appropriate.

Figure 3:
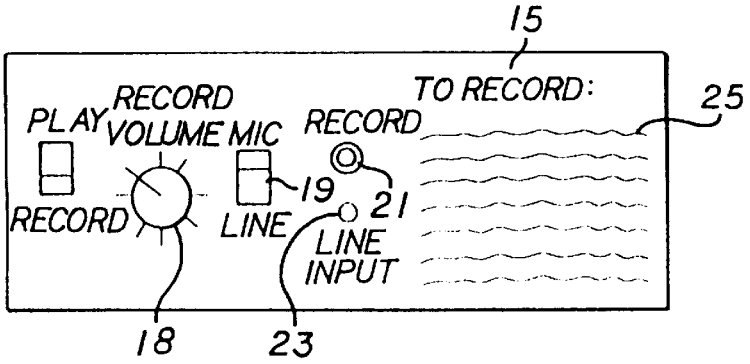
FIG. 3 depicts a control panel mounted on the bottom of the main base unit shown in FIG. 1.
Figure 4:
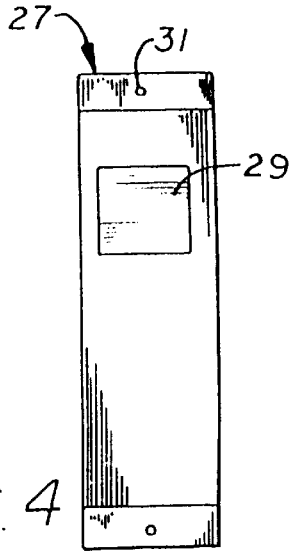
FIG. 4 is a representation of a typical doorbell device.

On the bottom of housing 3 is a control panel 15 shown in FIG. 3. A "play/record" switch 17, preferably a momentary pushbutton switch, permits the user to select the mode of operation of the base unit 1, i.e. whether it is to playback information recorded on a clip chip module 13 (released position) or record information onto a clip chip module 13 (pressed position).

If information is to be recorded on clip chip module 13, a record volume 18 is provided to set the appropriate record level.

A recording onto the clip chip module 13 may be made by means of speaking into a microphone behind slits 8 in housing 3 (FIG. 1), or by means of a line input to connector 23. A microphone/line switch 19 is provided to make the selection as to which source is to be used to record sound patterns on the clip chip module 13. To begin recording, the record pushbutton switch 21 is pushed to its on position, and it is released to end the recording process. A momentary pushbutton switch 21 is convenient for this function, since only a short burst (a few seconds) of sound is typically recorded to be played back upon the pushing of a doorbell. Since the invention could be used in applications other than as a doorbell, the record pushbutton 21 can be supplied, if desired, as a push-to-record and push-to-end-recording switch instead of a momentary switch.

A set of instructions 25 are printed on the control panel 15 for the convenience of the user.

A remote triggering device, such as a doorbell assembly 27 communicates energy to the base unit 1 when a pushbutton 29 is pressed. The pushbutton assembly 27 is mountable to the outside of a building by means of screw holes 31. Transmission of the event of pushing pushbutton 29 may be effected by an RF transmitter, a magnetic transformer coupling device (such as a transformer or Hall Effect device), an RLC spike generator, or other magnetic, electrostatic, or electromagnetic transmitting device. Direct wiring between the remote triggering device 27 and the base unit 1 can also be accommodated when, for example the invention replaces an existing prior art doorbell system.

Figure 5:
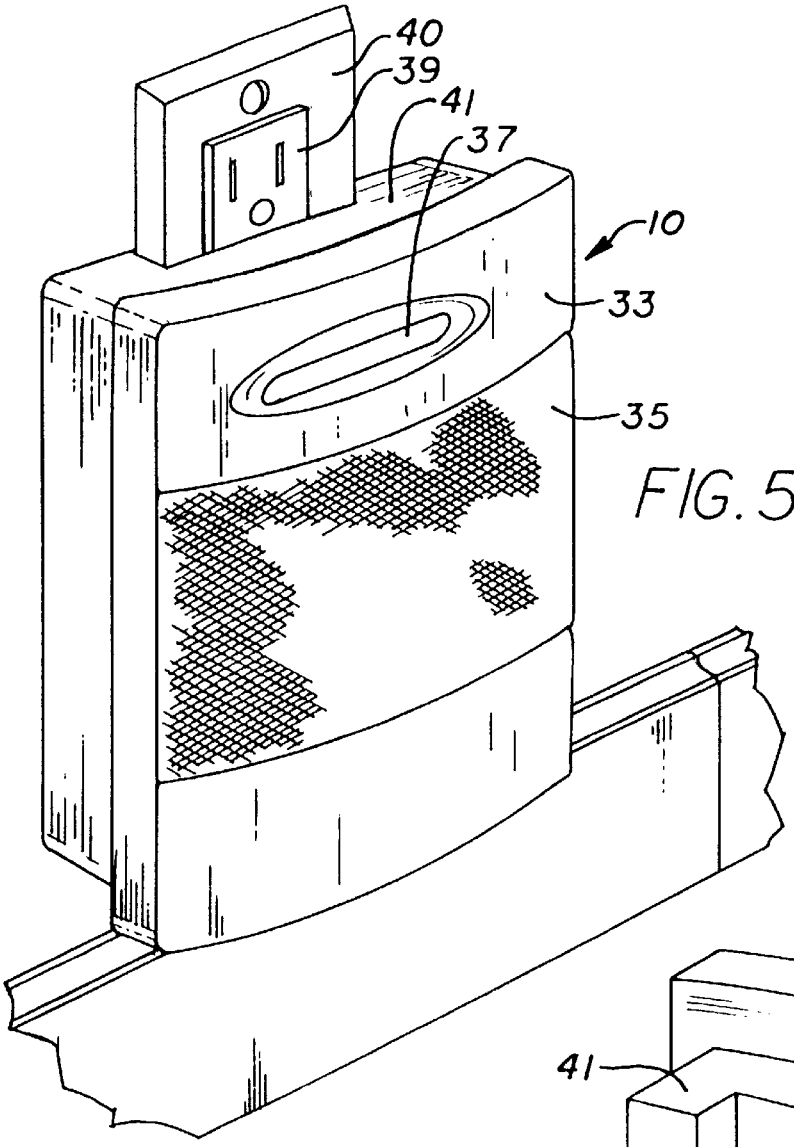
FIG. 5 is a perspective view of an alternate embodiment of the main base unit plugged into a common household receptacle.
Figure 6:
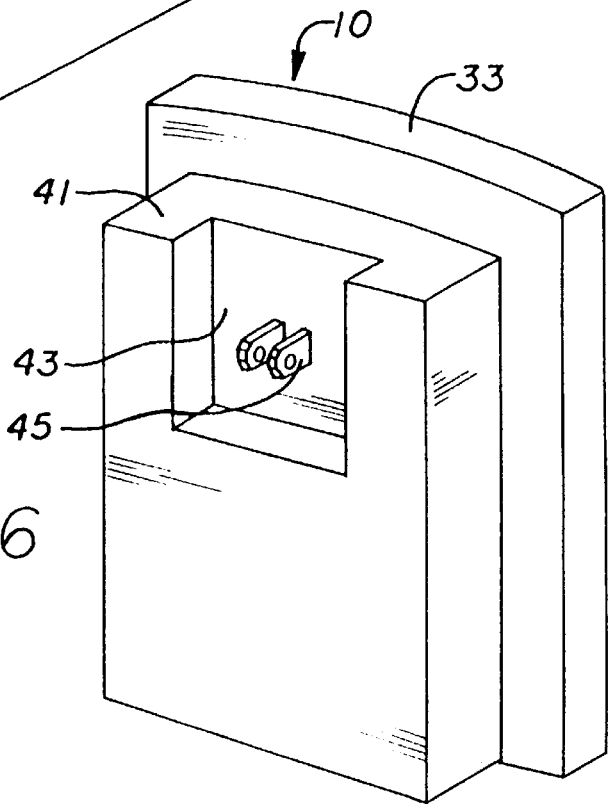
FIG. 6 is a rear perspective view of the main base unit of FIG. 5.

FIGS. 5 and 6 show an alternative base unit 10 design, FIG. 5 showing a perspective front view, and FIG. 6 showing a perspective rear view thereof. The base unit 10 is plugged into a common household receptacle 39, making connection thereto by a pair of contact prongs 45 disposed in recess 43 of the housing 41. A front housing cover 33 is shown to include a slot 37 for receiving a clip chip module, and has its center portion covered by a speaker grill cloth 35.

The design of the housing 41, in which recess 43 accommodates the lower half of a receptacle plate 40 leaves sufficient room above housing 41 for the insertion of another electrical AC plug to be plugged into the top receptacle portion.

Figure 7:
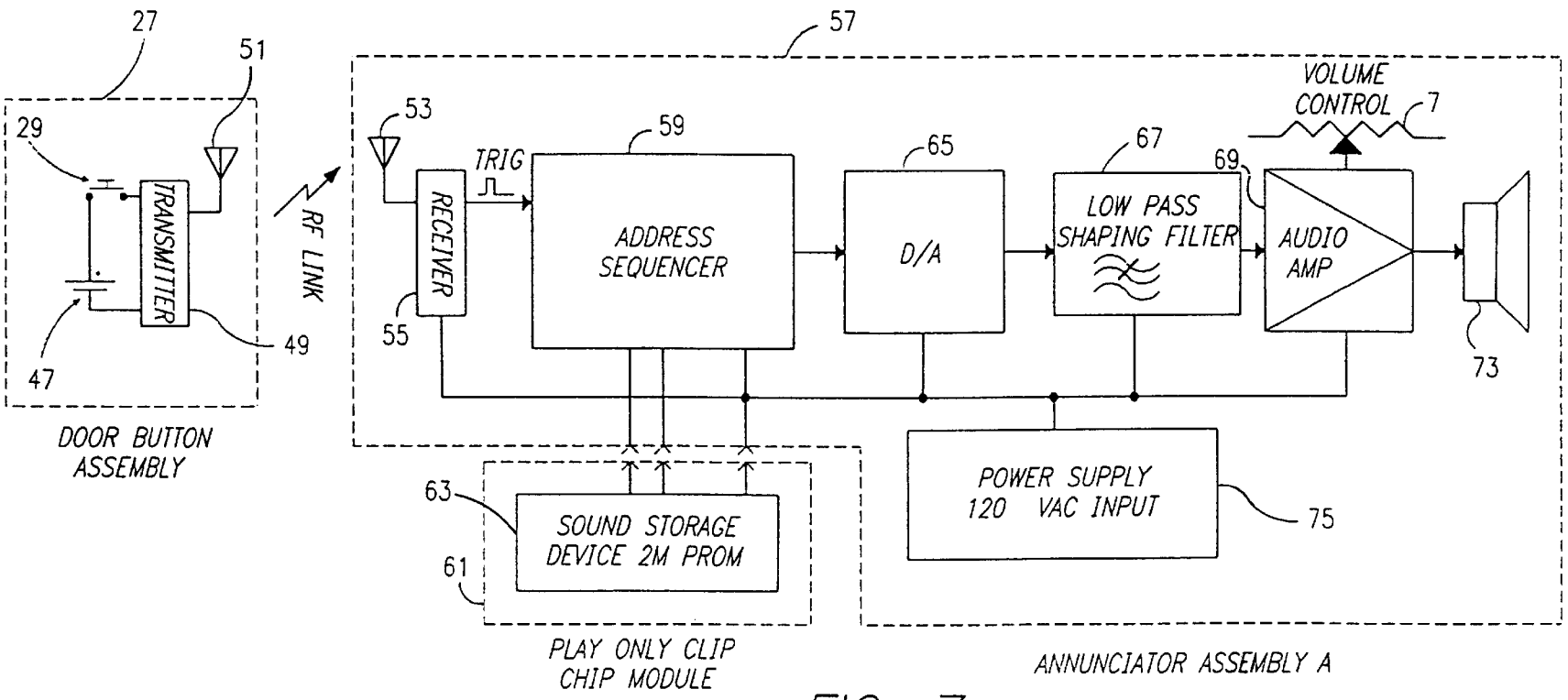
FIG. 7 is a schematic block diagram of a playback annunciator assembly and an associated doorbell button assembly.

FIG. 7 is a schematic block diagram of a basic playback only version of the electronic signaling system according to the present invention. FIG. 7 shows a door button assembly 27 in which a pushbutton 29 couples power from a battery 47 to an RF transmitter 49 driving an antenna 51.

A receiving RF antenna 53 is provided in a basic unit 57 identified in FIG. 7 as an Annunciator Assembly A.

Upon receiving the RF impulse from the door button assembly 27, antenna 53 supplies the received signal to a receiver 55 which thus produces a trigger signal at the output of receiver 55 which is applied to the address sequencer 59.

Plugged into the address sequencer 59 is a sound storage device 63 carried in a play only clip chip module 61. The sound storage device 63 in this example is a 2 megabyte programmable read-only memory, sufficiently large to have stored on it in digital form a reasonably long sound pattern such as a favorite song or a plurality of favorite songs selected by the user.

The clip chip module 61 is replaceable, so that the user may select, from a variety of available clip chip modules, the sounds or sound patterns that the user desires. In this connection, the sounds may be sounds of nature (rain, thunder, babbling brook, train whistles, etc.) or may be digitized recorded songs or verbal recitations, sound effects, etc.

In any event, the digitized sound patterns on sound storage PROM 63 are gated out of sequencer 59 and applied to a digital-to-analog (D/A) converter 65 which converts the digital serial data input from sequencer 59 to standard analog audio signals.

The analog signal from D/A 65 is sent to an audio amplifier 69 via a low pass shaping filter 67 which removes noise and reconstructs the analog signal more accurately by a shaping operation as is commonly known by those skilled in the audio art.

A volume control 7 sets the audio level out of audio amplifier 69 to drive the loudspeaker 73.

All electronic components of the base unit 57 are powered by a power supply 75 which, as hereinbefore described, derives its power from a 120 volt AC household receptacle.

In the operation of base unit 57, a particular clip chip module 61 is plugged into the base unit 57 which is inactive until a triggering signal from door button assembly 27 is received. Upon pushing pushbutton 29, radiated electromagnetic RF energy defines an RF link between the two antennas 51, 53 to create the trigger signal produced by receiver 55. Whatever sound pattern is on clip chip module 61 is then played out digitally and converted to an analog signal by D/A converter 65 for reproduction by the audio amplifier 69 and loudspeaker 73. The user thus hears a pleasing high fidelity (CD quality) sound pattern, preferably selectable by the user, which alerts the user that someone is at the door.

An extension of the use of the apparatus shown in FIG. 7 includes a modification to substitute an infrared light beam sensor arrangement (not shown) for the door button assembly 27 shown in FIG. 7. In such a case, the sound pattern stored on clip chip module 61 is played upon an object breaking the infrared light beam between the infrared transmitter and sensor. As the elements of an infrared transmitter receiver are well known, they are not shown in the drawings. Such an arrangement, however, may be desired for announcing to a customer entering a store as to what items may be on sale, or it may simply greet the customer in a friendly manner as the customer breaks the infrared light beam.

There are many other envisioned uses for the playback only version of the invention shown in the diagram of FIG. 7. It is to be understood, however, that the invention is not limited to implementation in the form of a doorbell system.

It is further to be noted that, since the sound patterns being reproduced in base unit 57 are derived from a digitally recorded replaceable medium, and since that medium may contain several megabytes of stored digital information, full orchestral or instrumental/voice sound patterns may be played back upon the occurrence of a trigger signal. Thus, the system of the present invention provides high fidelity audio sound to the recipient, as opposed to simple sequencing of a tone generator as is commonly done in the prior art.

Figure 8:
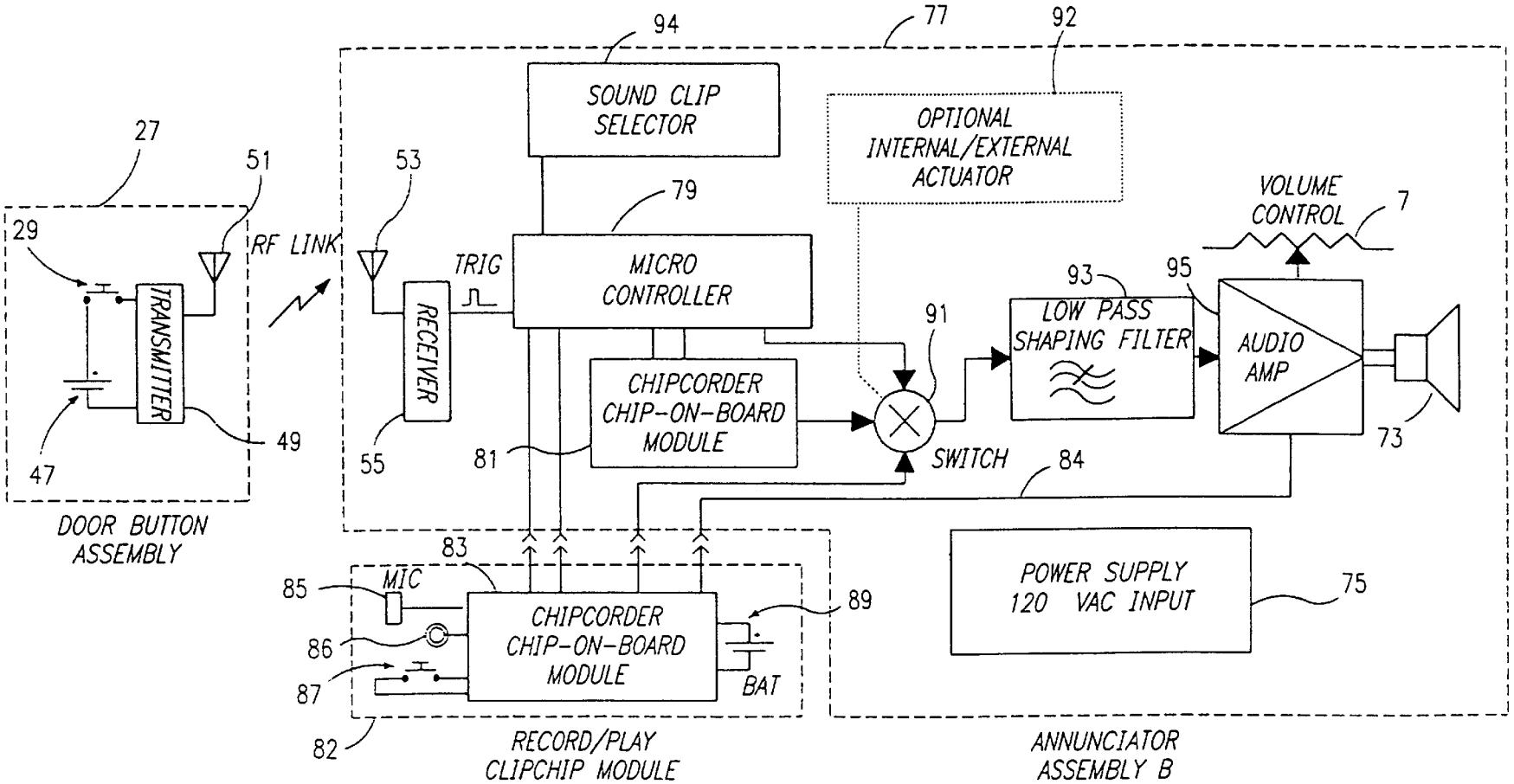
FIG. 8 is a schematic block diagram similar to that shown in FIG. 7, but with an additional removable sound recorder for the annunciator assembly.

FIG. 8 is a schematic diagram of an improvement over the basic playback only version shown in FIG. 7. In FIG. 8, a record/play clip chip module 82 is removably plugged into the base unit 77, identified in FIG. 8 as Annunciator Assembly B, but the record/play clip chip module 82 has significant additional function than the simple sound storage device 63 shown in FIG. 7. Thus, FIG. 8 offers the user an optional plug-in combination recorder and sound storage module feature.

In one variation of the FIG. 8 arrangement, the record/play clip chip module 82 would simply replace the clip chip module 61 of FIG. 7 which would result in the ability of the record/play clip chip module 82 to be removable from the FIG. 7 arrangement and taken to a remote location for recording information onto the ChipCorder® 83. When the record/play clip chip module 82 is then plugged into the base unit 57 of FIG. 7, the newly recorded, or additionally recorded, information on the ChipCorder® 83 may be played out through the loudspeaker 73 of FIG. 7.

A more flexible system is shown specifically by the block diagram of FIG. 8 to include a sound storage device in the format of a ChipCorder® 83 in the record/play clip chip module 82 as well as a sound storage device in the format of a ChipCorder® 81 installed in the base unit 77. The sound storage device 81 may be a factory installed clip chip, or it may be another insertable clip chip module arrangement similar to that shown in FIG. 7, i.e. without any recording capability.

Figure 10:
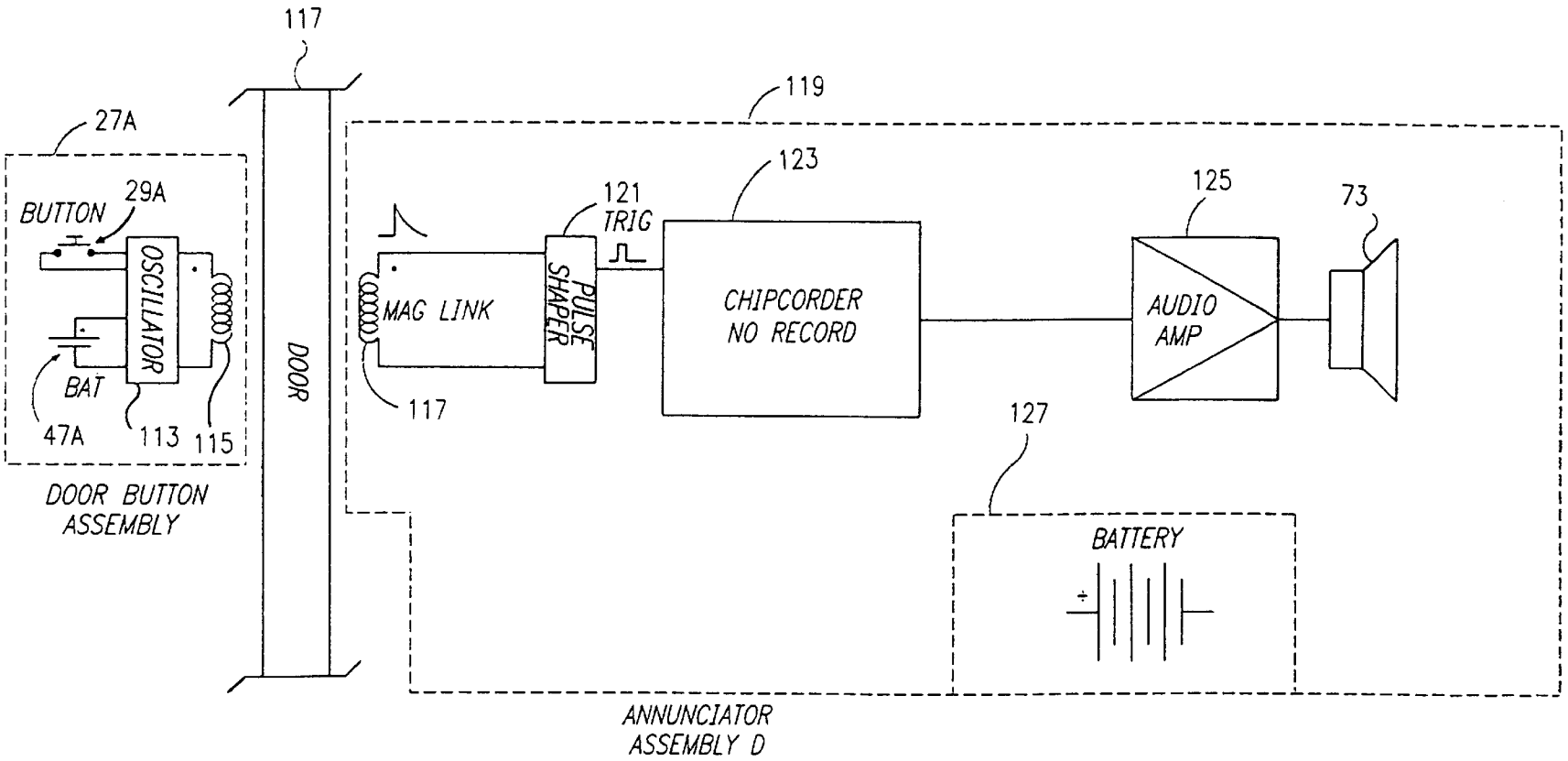
FIG. 10 is a schematic block diagram of a simplified electronic signaling system for use in a child's room.

A distinction is to be made between the nature of the sound storage device 63 in FIG. 7 and the ChipCorder® devices 81, 83, and 123 in FIG. 8 and FIG. 10. The sound storage device 63 is a playback-only digital memory device which outputs serialized digital data which must be converted to analog audio by external circuitry. The ChipCorder® devices 81, 83, and 123 include an analog audio storage device and are integral record/play devices complete with direct inputs for a microphone, a line level signal, and a record switch. It also provides direct outputs for connection to a microprocessor, and an analog audio output signal which is capable of driving a low powered speaker or headset. It also has an output line 84 which is indicative of whether or not audio is being outputted. This latter output is beneficially used as a mute control line when audio is not being outputted.

In any event, since there are two recorded, or recordable, media 81, 83 in FIG. 8, one fixed internally and the other removable, the system must provide the user with either a manual selection of one of the two sound sources or automatic selection of one of the two sources. A manual version would include the optional user operated internal/external actuator 92 (shown in dashed lines) which manually sets selector switch 91 to route either the audio output from ChipCorder® 81 or ChipCorder® 83 to low pass shaping filter 93 for play out. In such a case, the user has the option of leaving the record/play clip chip module 82 plugged in and yet have the flexibility of choosing which ChipCorder® 81, 83 is to be played back when the pushbutton 29 is pressed.

For an automatic version, the micro controller 79 detects whether a clip chip module is plugged in or not. If not, it sets switch 91 to connect to the internal storage device 81. If a clip chip module is plugged in, micro controller 79 sets switch 91 to select the output of the clip chip module. That is, if a record/play clip chip module 82 is not plugged in to the base unit 77, there is no input from record/play clip chip module 82 to switch 91, while there is a default input to switch 91 from the internal ChipCorder® 81. Thus, without a record/play clip chip module 82 in place and under control of the micro controller 79, switch 91 passes the analog audio from ChipCorder® 81 through a low pass filter 93 to drive audio amplifier 95 and speaker 73 in a manner described in connection with FIG. 7.

On the other hand, if a record/play clip chip module 82 is plugged into the base unit 77, then an output from ChipCorder® 83 to switch 91 sets switch 91 to default to the inserted record/play clip chip module 82. As a result, the audio information from ChipCorder® 83 is routed through switch 91 to the low pass filter 93, amplifier 95 and loudspeaker 73.

Line 84 from sound storage device 89 to audio amplifier 95 mutes the audio amplifier 95 when sound in not being reproduced.

The ChipCorder® 81 or 83 can have more than one song or other sound clip recorded in its memory. An operator may manipulate sound clip selector 94 to select one of the recorded sound clips for playback when the doorbell pushbutton 29 is pushed. The sound clip selector 94 instructs the micro controller 79 to make the desired selection from either ChipCorder® 81 or 82. For example, selector 94 may instruct micro controller 79 to choose the second recorded sound clip, and switch 91 then chooses whether the second sound clip from ChipCorder® 81 or the second sound clip from ChipCorder® 83 is to be played out. Alternatively, the micro controller may be factory configured to play ones of the multiple clip chip selections in random order. Other sound clip selection options can be easily programmed into micro controller 79, as desired. In this connection, the just-described clip chip select function can be employed in any of the main base units or self-contained clip chip modules shown and described herein.

Record/play clip chip module 82 is a self-contained unit having its own internal battery or power source 89. Power sources other than a battery 89 as shown in FIG. 8 may be employed. For example, in place of battery 89, a large (i.e., 1 Farad) capacitor can be placed in record/play clip chip module 82. Due to the small current drain for the record/play clip chip module 82, this size capacitor will sustain the internal electronics for several seconds, perhaps minutes, to permit removal of the module 82 for performing remote functions. For example, a built-in microphone 85 permits the user to take the record/play clip chip module 82 to any remote location to record the desirable sounds due to the portability of the clip chip module arrangement upon disconnection from base unit 77. The capacitor is recharged when the module 82 is plugged back into the base unit 77.

An external line input connector 86 is also provided so that the user may select a line level source from a number of peripheral devices, such as a CD-ROM, audio tape, videotape sound track, etc. The line level input signal on connector 86 may be mixed with the audio received by microphone 85 to permit the user to sing along with music derived from an external audio source. Such dual microphone/line input arrangements are common practice in the field of audio recording, and the circuitry that would be required to perform this function is assumed to be within the knowledge of the ordinary person skilled in the art, the record/play clip chip module 82 containing the appropriate circuitry for performing such function.

A record button 87, momentary or toggle, is likewise connected to begin the recording process for storage onto the ChipCorder® 83 when the user is ready to make the recording.

A modification of FIG. 8 would include altering the ChipCorder® 81 to be identical to the record/play clip chip module 82, i.e. the internal ChipCorder® 81 may also have the capability of recording from a microphone input or line level input (not shown) separately from the same functions of the record/play clip chip module 82. The power supply 75 may also be redundant with a self-contained battery (not shown) so that when the base unit 77 is removed from the wall receptacle, it also is a self-contained unit which may be carried to a remote recording location, or simply temporarily placed at a convenient location if the user is at a location at which the sound of the speaker could not be heard, or placed on a table near a person with a hearing impairment. For example, if the user is working in the yard or in a garage or basement, he or she can still hear a response from the main unit 77 and thus be made aware of a visitor at the door.

Figure 9:
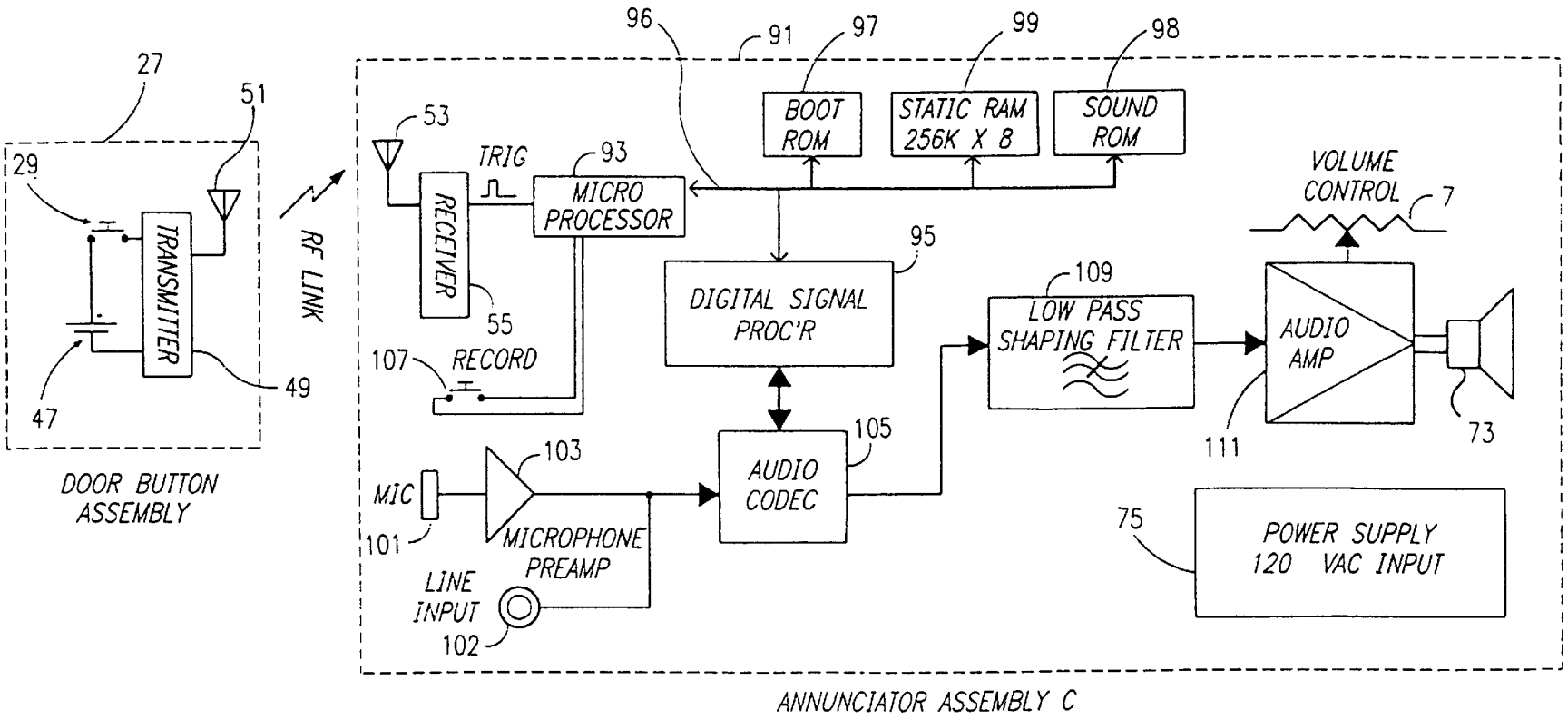
FIG. 9 is a schematic block diagram similar to that shown in FIG. 7, but with a recording device internal to the annunciator assembly.

FIG. 9 is another variation of the base unit 91, identified in FIG. 9 as Annunciator Assembly C. Base unit 91 also has an RF receiver antenna 53 and receiver 55 to produce a triggering signal applied to a microprocessor 93 which may be implemented by programming a programmable logic device (PLD).

Microprocessor 93, boot read-only-memory (ROM) 97, static random access memory (RAM) 99, sound ROM 98, and the digital signal processor 95 are all connected via a communication bus 96.

Boot ROM 97 holds a startup program which contains setup instructions for base unit 91 when power is applied from a cold, or off, state of the unit. Boot ROM 97 also has built into it instructions and control functions for effecting standard housekeeping chores.

Microprocessor 93 receives the triggering signal and record button 107 output and contains the control instructions for digital signal processor 95, depending upon which input to microprocessor 93 is active.

The static RAM function block 99 is a temporary calculation area, taking information from microprocessor 93 and holding data temporarily while microprocessor does its analysis.

Sound ROM 98 is a digital data storage device in which sound clips are stored digitally. It may be installed in the main unit 91 or may be a plug-in module similar to the digital sound storage device 63 of FIG. 7.

The main function of digital signal processor 95 is to convert analog audio inputs to digital data for storage in sound ROM, and for converting digitally stored sound clips retrieved from sound ROM 98 to analog format for passing on to low pass shaping filter 109, audio amplifier 111, and speaker 73 for playback.

The CODEC device 105 is a coding and decoding function block which, during the recording process, compresses input analog audio from microphone 101 through microphone preamplifier 103, or from line input 102, to produce a compressed analog signal to be sent to digital signal processor 95. On playback, CODEC device 105 decompresses the analog audio from digital signal processor 95. Such coding and decoding processing permits the use of a smaller capacity sound ROM 98 for the same amount of sound information to be stored, and it performs a noise reduction function as well.

FIG. 10 is a variation of the electronic signaling system according to the present invention for use in a child's room or play area. Typically, the child's room or play area would be closed off by a door 117, and, advantageously, the arrangement of FIG. 10 places the door button assembly 27A on one side of the door 117, and the base unit 119 (referred to in FIG. 10 as Annunciator Assembly D) on the other side of the door 117. A magnetic coupling through the door is provided by a transformer comprised of a primary 115 on one side of the door and a secondary 117 on the other side of the door. The primary 115 is pulsed by the application of power from battery 47A through a momentary pushbutton 29A creating a burst of oscillation from oscillator 113. The magnetic field built up in primary 115 passes through the door 117 and causes current to flow in the secondary 117 to produce a voltage spike sent to pulse shaper 121 to produce a triggering signal.

The triggering signal from pulse shaper 121 is applied to a sound storage device shown in FIG. 10 in the format of a ChipCorder® 123 which is a self contained microelectronic chip carrying the recorded audio information (recorded media) to produce an analog audio output signal applied to audio amplifier 125 and on to loudspeaker 73. Thus, upon pressing pushbutton 29A, a specific sound pattern stored on the ChipCorder® 123 will be played out for the child to hear.

The base unit 119 of FIG. 10 is intended to be mounted to the inside surface of a door 117, and therefore it must contain its own internal power source, i.e. battery 127. Simple battery-disconnect circuitry (not shown) may be implemented by a person of ordinary skill in the art to conserve battery power when no trigger signal is received. Details of such circuitry are not included here as that would be unnecessary and unwarranted.

An alternate through-the-door energy transfer device for the FIG. 10 arrangement is to provide a spring loaded permanent magnet in door button assembly 27A (no electronics required), and replace the transformer secondary 117 in main unit 119 with a Hall effect device. Upon pushing and releasing the pushbutton 29A, the small change in magnetic field is sensed by the Hall effect device to produce a voltage spike as input to pulse shaper 121.

Figure 11:
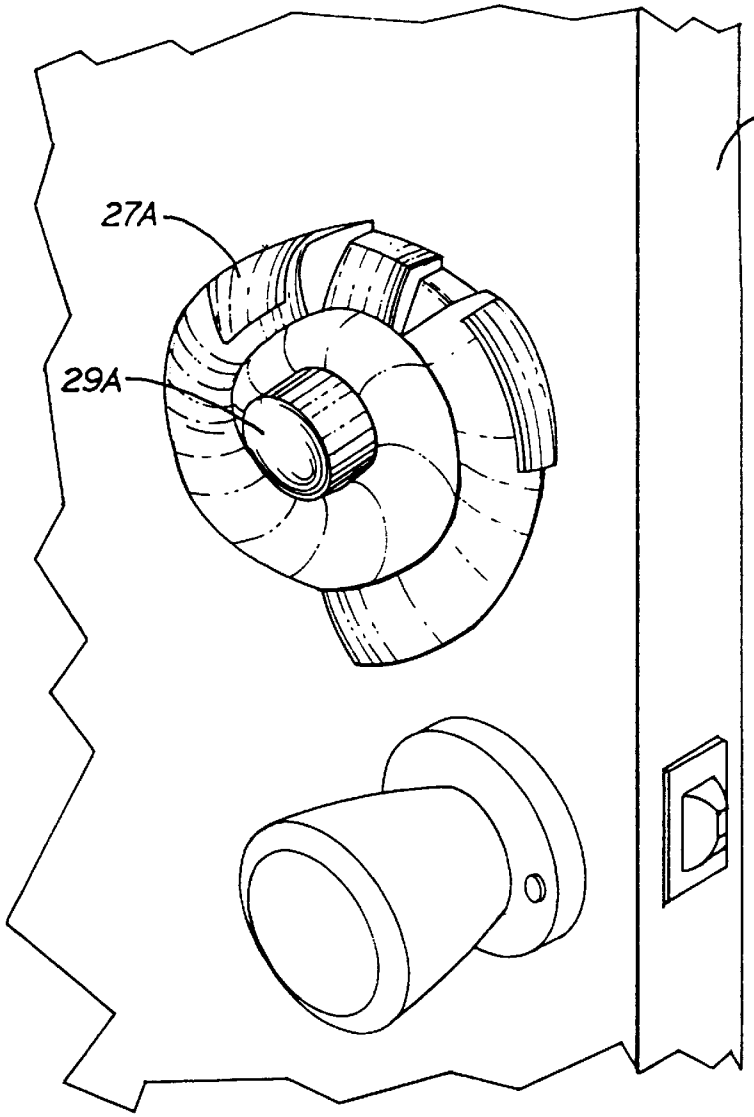
FIG. 11 is a perspective view of a door segment on which a pushbutton is mounted.

FIG. 11 is a perspective view of a portion of a door 117 on the outside of which is mounted the door button assembly 27A having a pushbutton 29A cleverly designed into an artistic item which may have a theme consistent with the theme of the sound pattern to be played out by the base unit 119 of FIG. 10. For example, a spaceship sound pattern may be played out by the base unit 119 of FIG. 10, and the door button assembly 27A may have a space age design theme as shown in FIG. 11.

The sound storage device 123 of FIG. 10 may be removably inserted into base unit 119 in a manner similar to that shown and described with reference to FIG. 7. It may also be recordable. In such a case, a removable and recordable medium 139, shown in FIGS. 13 and 14, will provide a variety of selections for playback upon pushing push button 29A.

Figure 12:
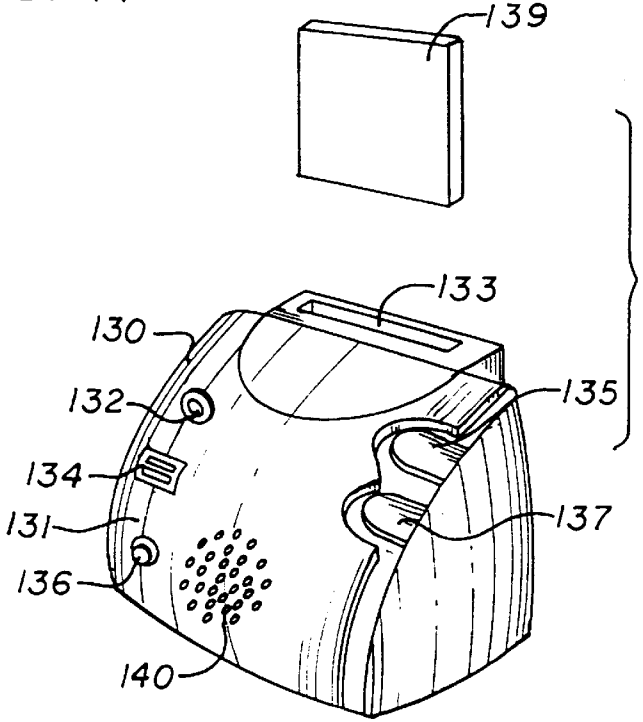
FIG. 12 is a perspective view of a self-contained, portable, recorder device and an insertable recording medium.

As shown in FIG. 12, the recordable medium 139 may be insertable into a slot 133 of a base station 130 adapted to record sounds onto the sound storage device 139. The sound storage device 139 may be recorded upon by means of a built-in microphone 134 or line input 136. In effect the base station 130 is a convenient desk model of the record/play clip chip module 82 shown in FIG. 8 with additional components such as a speaker 140, recording indicator 132, and a combination (or separate) record level and volume control 135.

The functional base station 130 shown in FIG. 12 can be dimensioned and sized to be hand held, if desired.

The purpose of base station 130 is to provide power, recording function control, and the ability to audition or playback newly recorded sounds without having to re-install the clip chip module in a base unit in order to hear what has been captured. Base station 130 is designed to accept a clip chip module with electrical connections to the ChipCorder® inside. Because a ChipCorder® has a built-in speaker amplifier strong enough to power a miniature speaker adequately, the base station 130 provides all the necessary functionality to record and play newly captured sounds remotely.

Figure 14:
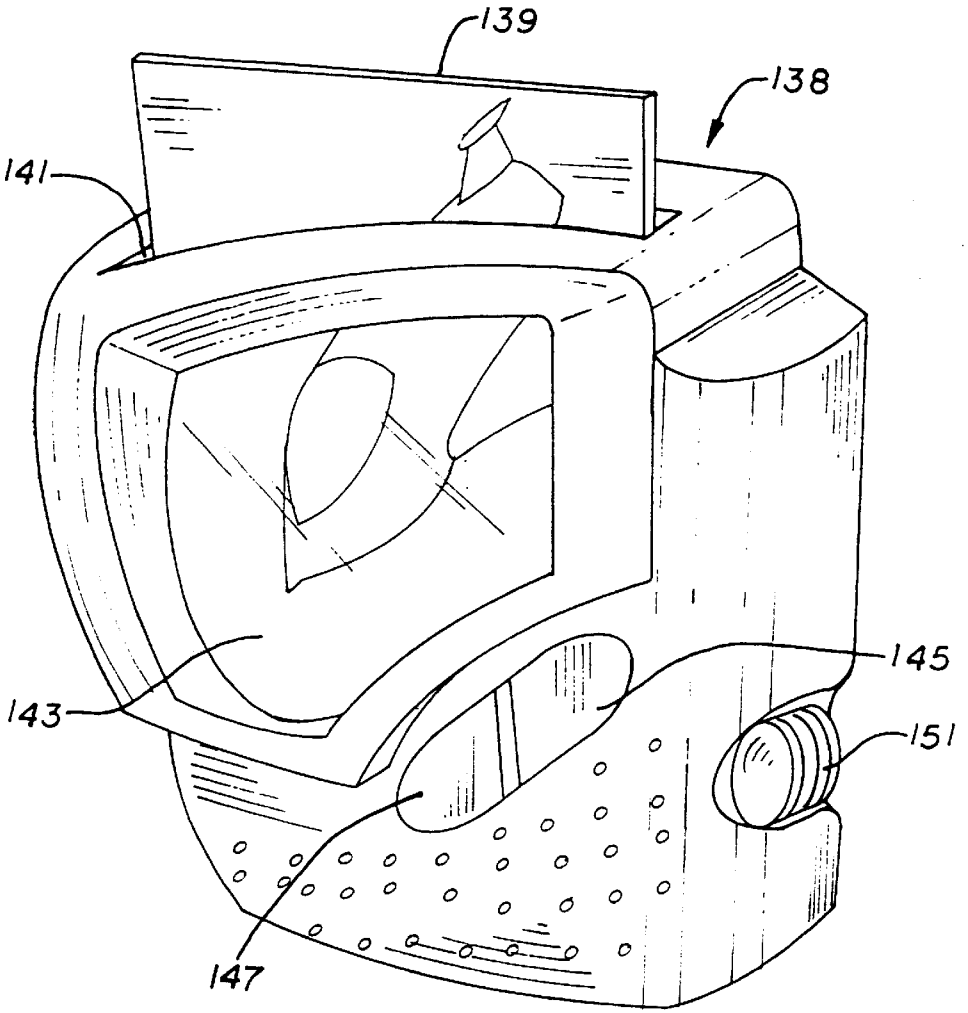
FIG. 14 is a perspective view of the arrangement shown in FIG. 13 with the thematic card fully inserted into the child base unit and positioned to display the artwork on the card through a window provided in the base unit.
Figure 13:
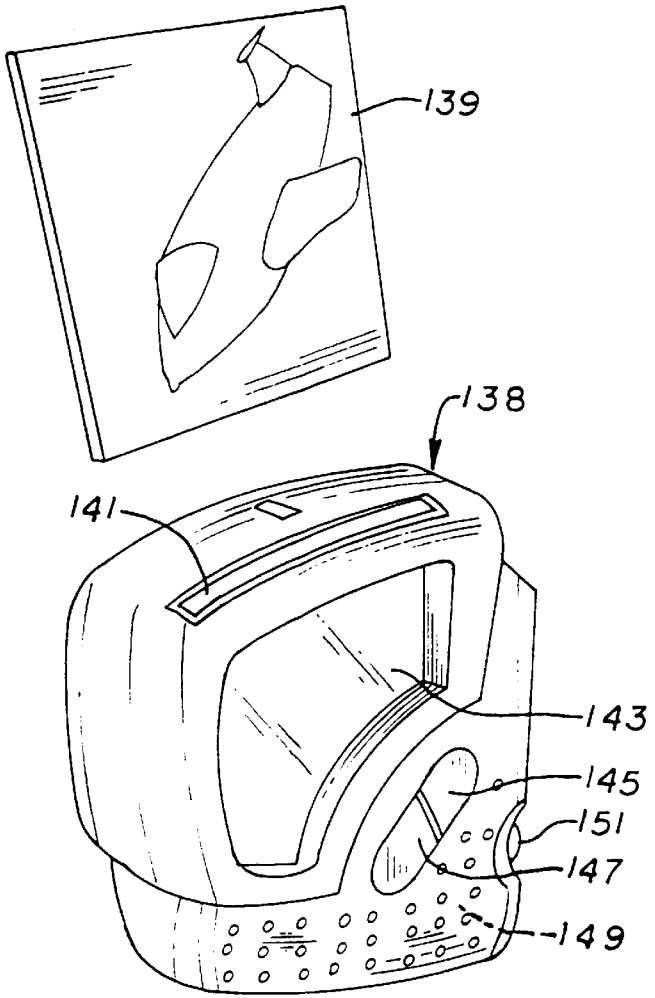
FIG. 13 is a perspective view of a child's electronic signaling playback base unit for receiving an insertable thematic sound card, as shown.

FIGS. 13 and 14 demonstrate the use of a sound card 139 insertable into a colorful and attractive base unit 138 (which optionally may also be adapted as a base station recorder).

The base unit 138 has a card-receiving slot 141 in its top surface for receiving the sound card 139. The sound card 139 preferably has artwork thereon to depict a character, place, or thing which would be interesting to a child. The sound card 139 carries the sound storage device 123 (FIG. 10) in a concealed fashion within the card 139, so as not to be subject to tampering by the child. On inserting the sound card 139 into slot 141 of the base unit 138, however, certain contacts are made between the sound storage device embedded in sound card 139 with the appropriate connector contacts (not shown) of the base unit 138.

When the sound card 139 is fully inserted within base unit 138, the artwork on the face of the sound card 139 shows through a window 143 provided in the front of the base-unit 138. Operating controls, such as on, off, or sound pattern select are shown as buttons 145 and 147 in FIGS. 13 and 14. A speaker 149 (not visible) is mounted behind a perforated front surface of base unit 138, and a volume control 151 may be provided to adjust the volume of the speaker at the discretion of the user.

There has been described various embodiments of the present invention to provide an electronic signaling system having the capability to record and/or reproduce a series or set of unique sound patterns which are produced upon reception of a triggering signal from a remote triggering device, such as a doorbell pushbutton. As described, the sound patterns may be factory installed or remotely recorded and stored by the user.

In the various embodiments shown and described, power may be applied to the main base unit by means of plugging the base unit into an AC line voltage receptacle, or the entire system may be portable, in which case the power is supplied by an internal battery or storage capacitor.

The base unit may be self-contained and provide a playback only output upon being triggered, or it may have a built-in sound recorder, or it may have a removable plug-in self-contained sound recorder and associated medium, or both the base unit and the removable recorder may be implemented the same with both playback and record features. A removable plugable recorder module, when removed, can achieve the same recording functionality and results as a self-contained base unit as described.

The recorded and recordable sound storage devices are of the type which are capable of retaining sound patterns in the absence of power, e.g. they are nonvolatile memory devices. No constraints are made as to length, memory size, or complexity of the sound patterns which can be stored.

For the removable plug-in modules, such plug-in modules may or may not draw power from the main unit. In any case, since the plug-in modules are envisioned to be nonvolatile ICs, they do not require a battery or other source of power to retain the sound records stored within them. The modules may have an energy storage component, rechargeable by the main unit to facilitate the recording functions described. They may be encased in a variety of materials, such as plastic, cardboard, or metal, and may have thematic designs signifying the type of sound recorded in the module.

A simple low cost medium is envisioned, especially for the child's version, whereby the sound chip can be placed on a flat carrier of cardboard or plastic or other low cost material, with the chip embedded in the carrier (sound card) with electrical contacts supplying the necessary electrical pads to the main unit for reproduction of the stored sounds.

Applications of the invention include personal paging, institutional "call" devices, room-to-room signaling, exterior entry alert, interior room signaling, and other yet to be determined uses.

As described, means are provided for setting sound levels and other operating functions as necessary to carry out the required functions in order to realize the above-stated objectives. Installation of either the base unit or the remote triggering device is designed such that only common hand tools, if any, are required.

Employing the circuit diagrams of FIGS. 8 and 9, additional function may be added to the base units 77, 91, such additional functions being under the control of the microprocessors 79, 95 of these two circuits. More specifically, but not shown in the drawings, add-on functional module components, such as a smoke detector, a security/power failure light, a digital clock, and a motion detector security alarm, may be purchased separately and plugged into the base units, adding a range of capabilities to the system. The additional components can work together, such as the motion detector triggering both an alarm and a flashing security light.

The device can also be employed as a greeting system in stores where, for example, a motion detector would trigger a musical or vocal message as a customer enters the store.

As described, the base units will accept pre-recorded sound modules marketed under the name "Clip Chips". Their short, analog or digitally stored sound or music clips will be comprised of both licensed and public domain sonic clichès, such as the opening strains of Beethoven's Fifth Symphony, or the Guitar Solo from "Layla", or the introduction to "Louie Louie", etc. Musical genres of Clip Chips will include Classic Rock Riffs, Musical Messages, and Classical Themes. There will also be a series of sound effect Clip Chips, such as angry barking dogs (for security purposes, etc.), cartoon voices, and nature sounds.

Having reference to the block diagrams of FIGS. 7–10: the micro controller 79 is available from Microchip Corporation of Chandler, Ariz., part No. PIC 16C57, or equivalent;

the sound storage devices 81, 83 are available from Information Storage Devices, Inc. of San Jose, Calif.; the microprocessor (PLD) 93 is available from Altera; the digital processor 95 is available from Analog Devices, Inc. as part No. 2104; the audio storage device 105 is a Code/Decode IC available from Texas Instruments, Analog Devices, Inc., or National Semiconductor, among others; and the sound storage devices 81, 83, and 123 are known as ISD ChipCorder® s available from Information Storage Devices of San Jose Calif.

While only certain embodiments of the invention have been set forth above, alternative embodiments and various modifications will be apparent from the above description and the accompanying drawing to those skilled in the art.

For example, the communication link between the triggering device and the base units may be implemented by common bell wire, rather than the disclosed wireless schemes.

As another example, the optional internal/external actuator 92 and the sound clip selector 94 function blocks shown in FIG. 8 may be employed, if desired, in any of the other embodiments shown and described herein.

Further, while there are several methods and sophistication levels of recording and reproducing sound samples in a solid state circuit (e.g., a microprocessor with internal data converters), it is an ideal goal that the electronic signaling system of the present invention provide the best quality audio/sound at the lowest cost to the user. Practically, a balance between quality and cost will be arrived at for each application.

These and other alternatives are considered equivalents and within the spirit and scope of the present invention.

What is claimed is:

1. An electronic signaling system comprising:

a base unit including an audio media player for reproducing a recorded audio signal from an inserted circuit medium having data recorded thereon representing a series or set of unique sound patterns, and an audio output stage for producing an audio output responsive to the occurrence of a trigger signal;

a remote triggering device including a signal generator for communicating energy from said triggering device to said base unit;

a receiving device in said base unit for intercepting said energy communicated from said triggering device and generating said trigger signal to reproduce said recorded audio signal and produce said audio output; and a theme card circuit medium carrier displaying artwork depicting a theme consistent with said unique sound patterns, said circuit medium disposed on or in said theme card.

2. The electronic signaling system as claimed in claim 1, wherein said base unit has a slot therein for receiving replaceable ones of said theme cards each carrying a coordinated circuit medium.

3. The electronic signaling system as claimed in claim 2, wherein said base unit comprises a housing having a viewing window therein, said slot penetrating said housing to allow one of said theme cards to at least partially enter said housing and position said artwork to be viewable through said window.

* * * * *